US008139972B2

(12) United States Patent
Abe et al.

(10) Patent No.: US 8,139,972 B2
(45) Date of Patent: Mar. 20, 2012

(54) PROCESS CARTRIDGE AND ELECTROPHOTOGRAPHIC IMAGE FORMING APPARATUS

(75) Inventors: Daisuke Abe, Suntou-gun (JP); Naoya Asanuma, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 520 days.

(21) Appl. No.: 12/362,094

(22) Filed: Jan. 29, 2009

(65) Prior Publication Data

US 2010/0028039 A1 Feb. 4, 2010

(30) Foreign Application Priority Data

Jul. 31, 2008 (JP) ..... 2008-198424

(51) Int. Cl.
*G03G 15/00* (2006.01)

(52) U.S. Cl. ..... 399/90; 399/111

(58) Field of Classification Search ..... 399/24, 399/25, 27–29, 75, 90, 102–106, 111–114
See application file for complete search history.

(56) References Cited

U.S. PATENT DOCUMENTS 6,178,302 B1 * 1/2001 Nagashima et al. ..... 399/106
6,334,035 B1 12/2001 Abe et al. ..... 399/106
6,377,759 B1 4/2002 Abe et al. ..... 399/27
6,463,225 B1 10/2002 Abe et al. ..... 399/27
6,473,585 B2 10/2002 Abe et al. ..... 399/254
6,505,008 B2 1/2003 Abe ..... 399/27
6,512,903 B2 * 1/2003 Chadani ..... 399/106
6,535,699 B1 3/2003 Abe et al. ..... 399/27
6,571,070 B2 5/2003 Oguma et al. ..... 399/27
6,823,155 B2 11/2004 Tsuda et al. ..... 399/111
6,934,485 B2 8/2005 Miyabe et al. ..... 399/90
6,993,264 B2 1/2006 Oguma et al. ..... 399/90
7,162,176 B2 1/2007 Oguma et al. ..... 399/90
7,203,442 B2 4/2007 Matsubara et al. ..... 399/90
7,242,885 B2 7/2007 Abe et al. ..... 399/90
7,315,706 B2 1/2008 Oguma et al. ..... 399/90

* cited by examiner

*Primary Examiner* — Hoan Tran
(74) *Attorney, Agent, or Firm* — Fitzpatrick, Cella, Harper & Scinto

(57) ABSTRACT

A process cartridge detachably mountable to a main assembly of an electrophotographic image forming apparatus includes an electrophotographic photosensitive drum, a developing roller, a developer accommodator including two frames two end portion members, supporting the roller, a first member providing an electrostatic capacity between itself and the roller when a developing bias voltage is applied to the developing roller, and a second member including a contact portion elastically contacting to a bent portion of the accommodator, and a first electrical contact portion, electrically connected to the contact portion, for transmitting, to the main assembly, an electric signal corresponding to a value of the electrostatic capacity provided between the developing roller and the first member. The second member is mounted to one end portion member such that the contact portion is inside the one end portion member and the first electrical contact portion is outside the one end portion member.

16 Claims, 10 Drawing Sheets

(a)

(b)

(c)

(a)

(b)

PROCESS CARTRIDGE AND ELECTROPHOTOGRAPHIC IMAGE FORMING APPARATUS

FIELD OF THE INVENTION AND RELATED ART

The present invention relates to a process cartridge, and also, an electrophotographic image forming apparatus in which a process cartridge is removably mountable.

Here, a "process cartridge" is a cartridge in which an electrophotographic photosensitive member and processing means are integrally disposed, and which is removably mountable in the main assembly of an electrophotographic image forming apparatus. "Processing means" are means for processing an electrophotographic photosensitive member. One of the examples of a process cartridge is a cartridge in which an electrophotographic photosensitive member, and at least one processing means among a developing means, a charging means, and a cleaning means, are integrally provided. Another example of a process cartridge is a cartridge in which a charging means and cleaning means, which are processing means, and an electrophotographic photosensitive member, are integrally disposed. Further, there is a cartridge in which a developing means as the processing means, and an electrophotographic photosensitive member, are integrally disposed.

An "electrophotographic image forming apparatus" is an apparatus which forms an image on recording medium with the use of an electrophotographic image forming method. As examples of an apparatus which can be listed as an electrophotographic image forming apparatus, there are an electrophotographic copying machine, an electrophotographic printer (LED printer, laser beam printer, and son on.), a facsimile apparatus, a wordprocessor, and so on.

"Recording medium" is medium on which an image is formed. As examples of medium which may be listed as "recording medium," there are a sheet of paper, OHP sheet, or the like.

The "main assembly" of an electrophotographic image forming apparatus is what remains after the removal of process cartridges from an electrophotographic image forming apparatus.

A process cartridge system has long been used in the field of an electrophotographic image forming apparatus. A process cartridge makes it possible for a use of an electrophotographic image forming apparatus to maintain the electrophotographic image forming apparatus on his or her own, that is, without relying on a service person. Thus, it can drastically improve an electrophotographic image forming apparatus in operational efficiency.

As for the electrical contact of a process cartridge, the one structured as follows has long been known.

That is, a process cartridge is made up of roughly two portions. On portion, which hereafter may be referred to as the first portion, is made up of a frame, and the components supported by the frame. The other portion, which hereafter may be referred to as the second portion, is also made up of a frame, and the components supported by the frame. The first and second portions are provided with the first and second electrical contacts, respectively. The first and second electrical contacts come into contact with each other as the frame of the first portion, and the frame of the second portions, are welded to each other. More specifically, the two electrical contacts come into contact with each other at the joint between the two frames. Further, in order to prevent toner from leaking through the joint between the two frames, the area of contact between the first and second electrical contacts is surrounded by an elastic sealing member (U.S. Pat. No. 6,571,070).

The above-described technology is very effective to ensure that the electrical contact of the first portion, and the electrical contact of the second portion, come into contact with each other, and remain in contact with each other.

SUMMARY OF THE INVENTION

The present invention is a further development of the above-described prior technology.

The primary object of the present invention is to a process cartridge whose electrically conductive first member, which extends inward, as well as the outward, of the developer storage portion of the process cartridge, is significantly better positioned in terms of special efficiency than the electrically conductive first member of a process cartridge in accordance with the prior art.

Another object of the present invention is to provide a process cartridge whose electrically conductive first and second members are ensured to make electrical connection with each other.

Another object of the present invention is to provide an electrophotographic image forming apparatus in which a process cartridge in accordance with the present invention is removably mountable.

Another object of the present invention is to ensure that the electrical contacts in a process cartridge make contact, and remain in contact, with their counterparts.

According to an aspect of the present invention, there is provided a process cartridge detachably mountable to a main assembly of an electrophotographic image forming apparatus, said process cartridge comprising an electrophotographic photosensitive drum; a developing roller for developing an electrostatic latent image formed on said electrophotographic photosensitive drum; a developer accommodating portion for accommodating the developer to be used for development of the electrostatic latent image by said developing roller, said developer accommodating portion including a first frame having an opening extended in a longitudinal direction of said developing roller for supplying accommodated developer to said developing roller, and a second frame mounted to said first frame by being bonded at a periphery thereof except for a non-bonding portion provided in a direction substantially perpendicular to the longitudinal direction at one longitudinal end portion; one end portion member, mounted to said one longitudinal end portion, for supporting one end of said developing roller; an another end portion member, mounted to the other longitudinal end portion of said developer accommodating portion, for supporting the other end of said developing roller; a first electroconductive member for providing an electrostatic capacity between itself and said developing roller when a developing bias voltage is applied to said developing roller, said first electroconductive member including an inner side portion provided on said second frame along the longitudinal direction and placed in said developer accommodating portion, and an outer side portion extending from the inner side portion through the non-bonded portion to an outside of said developer accommodating portion where said outer side portion is bent to provide a bent portion; and a second electroconductive member including a contact portion elastically contacting to said bent portion, and a first electrical contact portion, electrically connected to said contact portion, for transmitting, to the main assembly, an electric signal corresponding to a value of the electrostatic capacity provided between said developing roller and said first electroconductive member, wherein said second electroconductive member is mounted to said one end portion member such that contact portion is inside said one end portion member and that first electrical contact portion is outside said one end portion member.

According to another aspect of the present invention, there is provided an electrophotographic image forming apparatus to which said process cartridge is detachably mounting, said apparatus comprising a process cartridge including, a electrophotographic photosensitive drum, a developing roller for developing an electrostatic latent image formed on said electrophotographic photosensitive drum, a developer accommodating portion for accommodating the developer to be used for development of the electrostatic latent image by said developing roller, said developer accommodating portion including a first frame having an opening extended in a longitudinal direction of said developing roller for supplying accommodated developer to said developing roller, and a second frame mounted to said first frame by being bonded at a periphery thereof except for a non-bonding portion provided in a direction substantially perpendicular to the longitudinal direction at one longitudinal end portion, one end portion member, mounted to said one longitudinal end portion, for supporting one end of said developing roller, an another end portion member, mounted to the other longitudinal end portion of said developer accommodating portion, for supporting the other end of said developing roller, a first electroconductive member for providing an electrostatic capacity between itself and said developing roller when a developing bias voltage is applied to said developing roller, said first electroconductive member including an inner side portion provided on said second frame along the longitudinal direction and placed in said developer accommodating portion, and an outer side portion extending from the inner side portion through the non-bonded portion to an outside of said developer accommodating portion where said outer side portion is bent to provide a bent portion, and a second electroconductive member including a contact portion elastically contacting to said bent portion, and a first electrical contact portion, electrically connected to said contact portion, for transmitting, to said main assembly, an electric signal corresponding to a value of the electrostatic capacity provided between said developing roller and said first electroconductive member, wherein said second electroconductive member is mounted to said one end portion member such that contact portion is inside said one end portion member and that first electrical contact portion is outside said one end portion member; and b) detecting means for detecting an amount of the developer of said process cartridge by an electric signal received from said first electrical contact portion.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter, the preferable embodiment of the present invention will be described with reference to the appended drawings. However, the functions, materials, and shapes of the structural components of the process cartridge and image forming apparatus in the preferred embodiment of the present invention, and the positional relationship among the structural components, are not intended to limit the present invention in scope, unless specifically noted. Further, once a given structural component (member) is described, it is the same in material, shape, etc., throughout this specification, unless specifically noted.

(General Structure)

Figure 1:
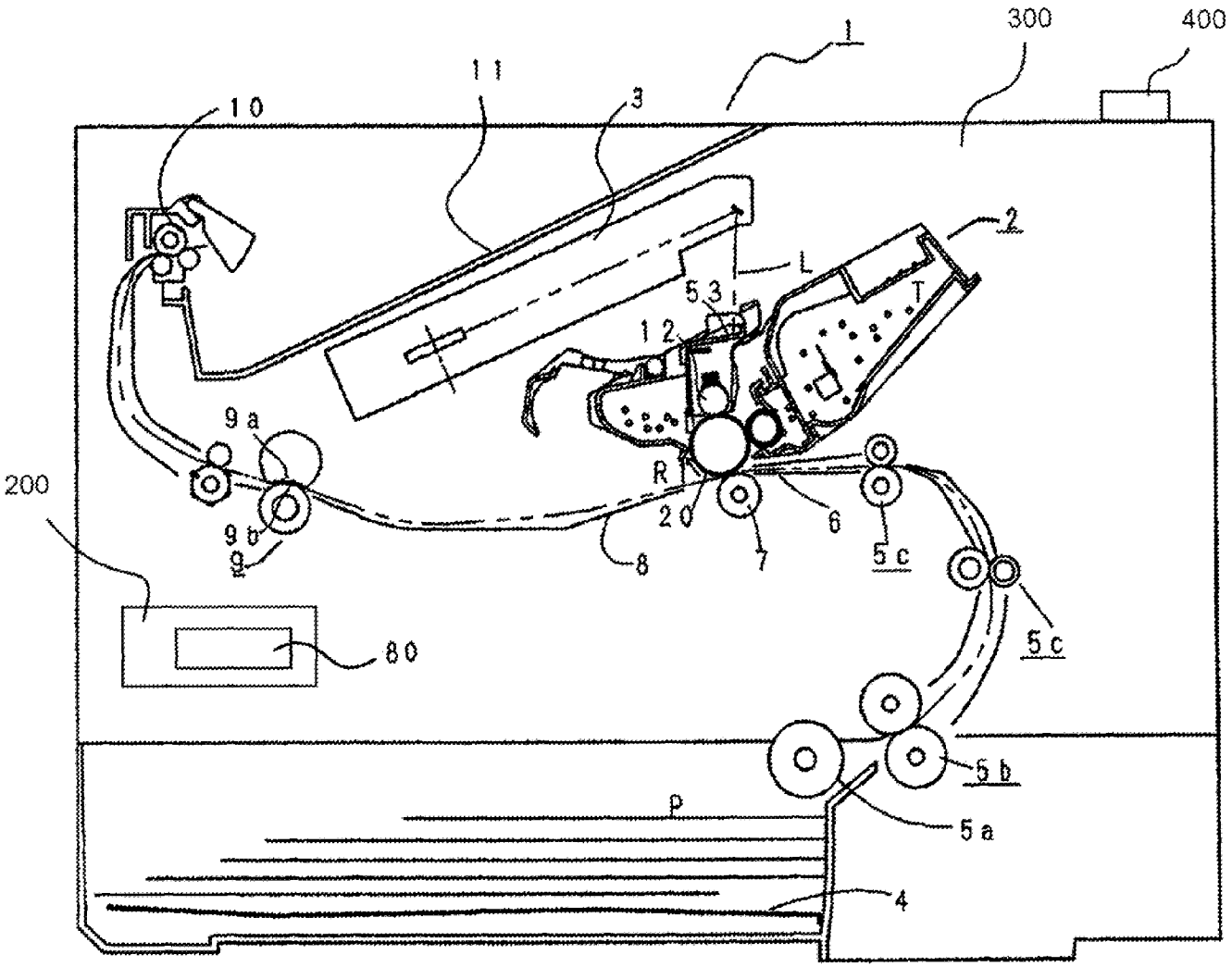
FIG. 1 is a sectional view of the image forming apparatus in the preferred embodiment of the present invention.
Figure 2:
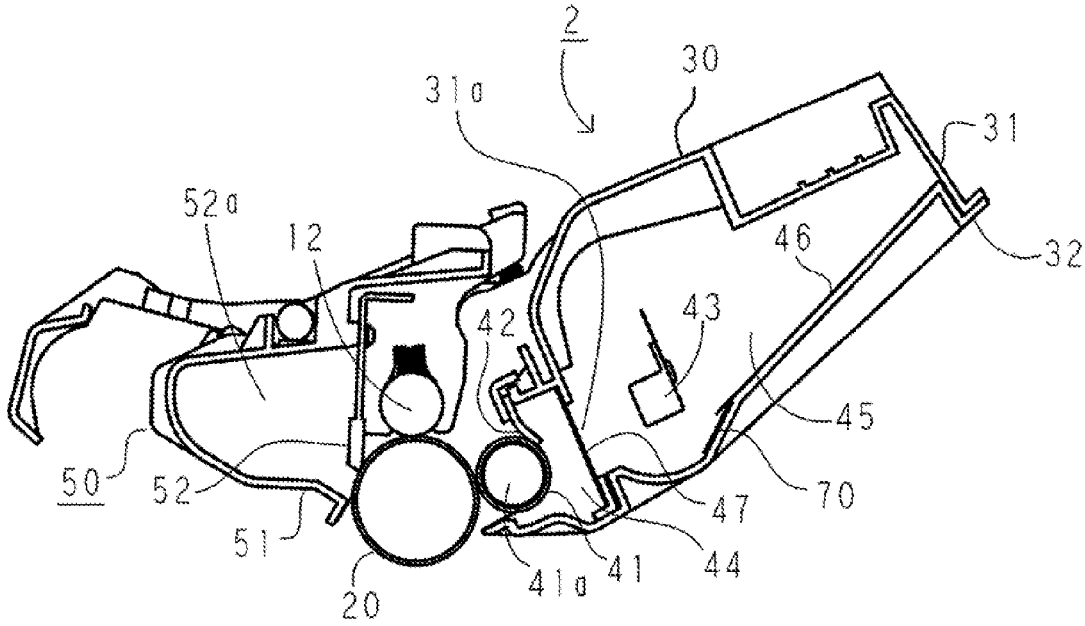
FIG. 2 is an enlarged sectional view of the cartridge in the preferred embodiment.

FIG. 1 is a sectional view of the electrophotographic image forming apparatus 300, in the preferred embodiment of the present invention, which is made up of the main assembly 1 of the image forming apparatus (which hereafter may be referred to simply as apparatus main assembly) and a process cartridge 2 (which hereafter may be referred to simply as cartridge). FIG. 2 is an enlarged sectional view of the cartridge 2. Next, referring to FIGS. 1 and 2, the overall structure of the image forming apparatus, and the image formation process of the image forming apparatus, will be described. The apparatus main assembly 1 is what remains after the removal of the cartridge 2 from the image forming apparatus 300.

The electrophotographic image forming apparatus 300 in this embodiment is a laser beam printer made up of the main assembly 1, and the cartridge 2 which is removably mountable in the main assembly 1. The apparatus main assembly 1 is provided with an exposing apparatus 3 (laser scanner unit). The apparatus main assembly 1 is structured so that when the cartridge 2 is in its image forming position in the main assembly 1, the exposing apparatus 3 is above the cartridge 2. The apparatus main assembly 1 is also provided with a sheet tray 4 for holding sheets P of recording medium. The apparatus main assembly 1 is structured so that when the cartridge 2 is in its image forming position in the apparatus main assembly 1, the sheet tray 4 is below the cartridge 2. Further, the apparatus main assembly 1 is provided with a pickup roller 5*a*, a pair of sheet conveyance rollers 5*b*, two pairs of sheet conveyance rollers 5*c*, a sheet transfer guide 6, a transfer charge roller 7, a sheet conveyance guide 8, a fixing apparatus 9, a pair of discharge rollers 10, a delivery tray 11, etc., which are positioned in the order in which they are listed.

(Description of Image Formation Process)

Next, the image formation process of this image forming apparatus will be described. First, a print start signal is to be inputted. As a print start signal is inputted, the electrophotographic photosensitive drum 20 (which hereafter will be referred to simply as drum 20) begins to be rotated in the direction indicated by an arrow mark R1 at a preset peripheral velocity (process speed). The peripheral surface of the drum 20 is in contact with a charge roller 12 to which bias voltage is being applied. Thus, the peripheral surface of the drum 20 is uniformly charged to a preset potential level by the charge roller 12.

A beam of laser light L is outputted from the exposing apparatus 3 while being modulated in accordance with the information regarding the image to be formed. More specifically, the beam of laser light L is projected into the cartridge 2 through an opening 53, with which the top wall of the cartridge 2 is provided. As the beam of laser light L is projected into the cartridge 2, it scans the charged portion of the peripheral surface of the drum 20. As a result, an electrostatic latent image, which is in accordance with the information regarding the intended image, is formed on the peripheral surface of the drum 20. This electrostatic latent image is developed by developer T (which hereafter may be referred to as toner), into a visible image, that is, an image formed of toner. The developer T is stored in a development unit 30.

To describe in more detail, the charge roller 12 is in contact with the drum 20, and charges the drum 20. It is rotated by the rotation of the drum 20. The development unit 30 develops the latent image on the drum 20, by supplying the portion of the drum 20, which is in the development area (station), with toner T.

The toner T is in a toner chamber 45, that is, a developer chamber. A stirring member 43 sends the toner T into a toner supply chamber 44 by its rotation. In the toner supply chamber 44, a development roller 41, which internally holds a magnetic roller 41*a* (stationary magnet), is rotated. Thus, as the development roller is rotated, the toner in the toner supply chamber 44 is coated on the peripheral surface of the development roller 41 by a development blade 42, while being frictionally charged. As a result, a layer of charged toner is formed on the peripheral surface of the development roller 41. Then, the toner T is transferred from the development roller 41 onto the drum 20 in the pattern of the latent image on the drum 20. As a result, an image which reflects the latent image is formed of toner T, on the peripheral surface of the drum 20. That is, the development roller 41 develops the electrostatic latent image formed on the drum 20, with the use of the toner T. The development blade 42 regulates the amount by which the toner T is coated on the peripheral surface of the development roller 41 per unit area, while frictionally charging the toner T.

The development unit 30 has the stirring member 43 and toner chamber 45.

While a toner image is formed on the peripheral surface of the drum 20, recording mediums P are fed by the pickup roller 5*a*, from the sheet tray 4, into the apparatus main assembly 1 in synchronism with the timing with which the aforementioned beam of light L is outputted. Then, the recording medium P is conveyed further into the apparatus main assembly 1 by the pair of sheet conveyance rollers 5*b*, and the pairs of sheet conveyance rollers 5*c*. Incidentally, the sheet tray 4 is in the bottom portion of the apparatus main assembly 1. After being fed into the apparatus main assembly 1, the recording medium P is conveyed by way of the transfer guide 6, and then, is delivered to a transfer station, which is the interface between the drum 20 and transfer charge roller 7. In the transfer station, the toner image is transferred from the drum 20 onto the recording medium P as if it were peeled away from the drum 20.

After the transfer of the toner image onto the recording medium P, the recording medium P is separated from the drum 20, and then, is conveyed to the fixing apparatus 9 along the conveyance guide 8. Then, the recording medium P is conveyed through the nip (interface) between a fixation roller 9*a* and a pressure roller 9*b*, of which the fixing apparatus 9 is made up. In this nip, the toner particles, of which the toner image is formed, are subjected to heat and pressure. As a result, the toner image becomes fixed to the recording medium P. After the fixation, the recording medium P is discharged into the delivery tray 11 by the pair of discharge rollers 10.

After the transfer of the toner image from the drum 20, the toner particles remaining on the peripheral surface of the drum 20 are removed by a cleaning blade 52. Then, the cleaned portion of the peripheral surface of the drum 20 is used again for the above described image formation process, which begins with the charging step. The toner removed from the drum 20 is stored in a toner chamber 52*a* for the removed toner.

In the case of the electrophotographic image forming apparatus in this embodiment, the charge roller 12, development roller 41, and cleaning blade 52, are the processing means for processing the drum 20.

(Structure of Process Cartridge)

Figure 3:
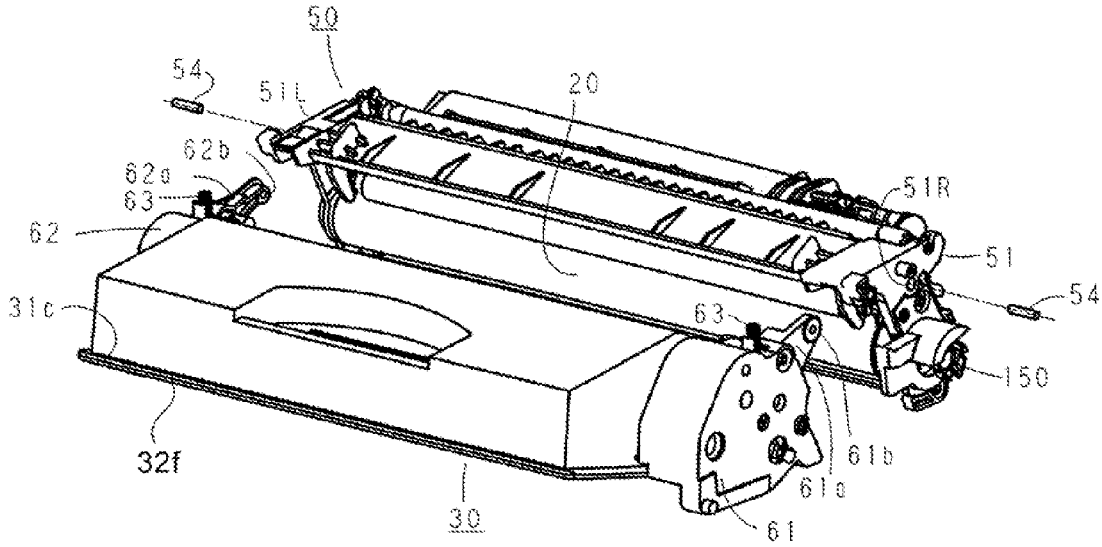
FIG. 3 is a perspective view of the cartridge in the preferred embodiment of the present invention, which shows the frame structure of the cartridge.
Figure 4:
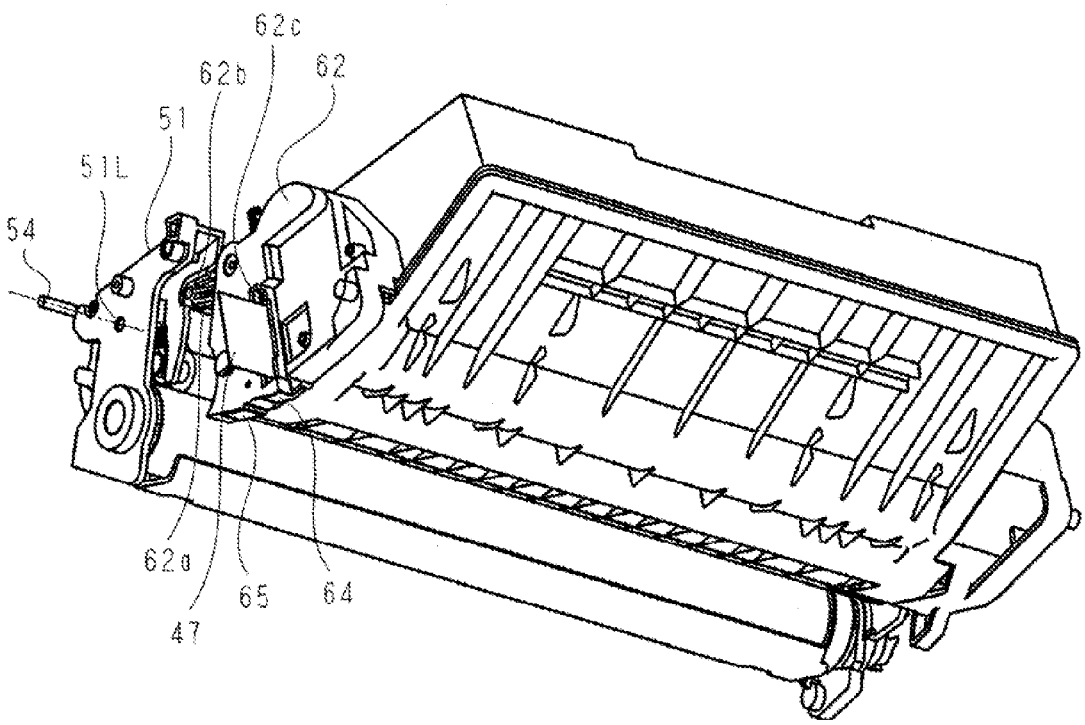
FIG. 4 also is a perspective view of the cartridge in the preferred embodiment of the present invention, which shows the frame structure of the cartridge.

FIGS. 3 and 4 are perspective views of the process cartridge 2, which are for describing the structure of the process cartridge 2.

Next, referring to FIGS. 2-4, the cartridge 2 will be described about its structure.

Referring to FIG. 2, a drum unit 50 is made up of the drum 20, charge roller 12, cleaning blade 52, and a drum unit frame 51, to which the preceding components are integrally attached.

The development unit 30 is made up of a toner storage container 31 (first sub-frame) and a lid 32 (second sub-frame). It has the toner chamber 41 as a developer storage portion, and the toner supply chamber 44. The toner storage container 31 and its lid 32 are integrated by welding or the like method. The development unit 30 is provided with an opening 31*a*. Before the cartridge 2 is used for the first time by a user, the opening 31*a* remains sealed with a removable developer seal 47 (which hereafter may be referred to as toner seal); after the filling of toner storage container 31 with toner, the toner seal 47 is welded to the toner storage chamber 31 to seal the opening 31*a* to keep the toner sealed in the toner chamber 45.

Before the cartridge 2 is used for the first time, more specifically, before the cartridge 2 is mounted into the apparatus main assembly 1 for the first time, the toner seal 47 is to be pulled out through a toner seal removal slot 62*c* in order to expose the opening 31*a*. As the toner seal 47 is pulled out, the toner T in the toner chamber 45 is supplied to the area in which the development roller 41 is located.

As for the means for attaching the lid 32 to the toner storage container 31, it does not need to be limited to welding. For example, the lid 32 and toner storage container 31 may be attached to each other by an adhesive, resin-to-resin bonding, or the two may be mechanically connected. Further, the means for attaching the toner seal 47 to the unit 30 does not need to be limited to welding. For example, it may be an adhesive or the like.

The toner storage container 31 is provided with a toner remainder amount detecting member 70 and a toner conveying member 46. The toner remaining amount detecting member 70 may be referred to as the first electrically conductive member. The toner conveying member 46 is a piece of flexible sheet. The toner remainder amount detecting member 70 and toner conveying member 46 are within the toner chamber 45. They are attached to the inward surface of the lid 32, that is, the surface which will become the bottom surface of the toner storage container 31 as the cartridge 2 is mounted into its image forming position in the apparatus main assembly 1.

As a development bias is applied to the development roller 41 from the apparatus main assembly 1 after the mounting of the cartridge 2 into the apparatus main assembly 1, a certain amount of static electricity is induced between development roller 41 and toner remainder amount detecting member 70. The amount of toner between the development roller 41 and toner remainder detecting member 70 changes with the consumption of the toner T. The dielectric constant of the toner T is greater than that of the air. Therefore, as the body of toner T in the development unit 30 changes in amount, it gradually changes in electrostatic capacity. Thus, the amount of the developer in the toner chamber 45 can be detected by sending electrical signals, which reflect the value of the abovementioned electrostatic capacity, to a detecting means 80 (FIG. 1) with which the control portion 200 of the apparatus main assembly 1 is provided.

As for the choice of the detecting means 80, any of the known detecting means may be employed as fits.

That is, if the amount of the toner T detected by the detecting means 80 is smaller than a preset value, it is displayed on a monitor portion 400 (FIG. 1), with which the apparatus main assembly 1 is provided, that the amount of developer in the development unit 30 became smaller than a desirable one. This information may be displayed on the monitor (unshown) of a personal computer or the like, to which the printer is connected. Thus, a user can recognized by watching the monitor that the amount of the toner T in the toner chamber 45 has become smaller than a preset one. Thus, the user can prepare a brand-new cartridge 2.

Regarding the display of the estimated amount of the toner in the toner chamber 45 on the abovementioned monitor portion of the printer, or monitor of the personal computer, the information on the monitor or the monitor portion is controlled by the electrical signals outputted by the control portion 200, which receives electrical signals from the detecting means 80. Further, the electrical signals which are outputted by the detecting member 70, and which reflect the value of the abovementioned electrostatic capacity, are transmitted to the detecting means 80 through a contact point 70*c*, a contact point 64*a*, contact point 64*b*, and a contact point 101. The contact points 70*c*, 64*a*, and 64*b* are the contact points of the process cartridge 2. The contact point 101 is the contact point of the contact of the detecting means 80 of the apparatus main assembly 1.

The detailed description of the toner remainder amount detecting member and toner conveying member will be given later.

Next, referring to FIGS. 3 and 4, the development unit 30 is provided with a pair of side covers 61 and 62, which make up the lengthwise end portions of the unit 30 (in terms of direction parallel to axial line of development roller 41), one for one. The side covers 61 and 62 support bearing members (unshown), one for one, by which the development roller 41 is rotatably supported.

The side covers 61 and 62 are provided with arm portions 61*a* and 62*a*, respectively, whose end portions have a through hole 61*b* (which is round in cross section) and a through hole 62*b* (which is oval in cross section), respectively. The drum unit frame 51 is provided with holes 51R and 51L for a pair of connective member 54, one for one, which are positioned so that as the drum unit 50 and development 30 unit are positioned in such a manner that the arm portions 61*a* and 62*a* fit into preset portions of the drum unit frame 51, the holes 61*b* and 62*b* of the arm portions 61*a* and 62*a* align with the holes 51R and 51L of the frame of the development unit 30, respectively. Thus, as the connective members 54 are put through the holes 61*b*, 51R, 51L, and 62*b*, the units 50 and 30 become connected to each other in such a manner that they are allowed to rotationally move relative to each other about the connective members 54. With the two units 50 and 30 being connected as described above, a pair compression springs 63 attached to the base portions of the arm portions 61*a* and 62*a*, respectively, remain in contact with the drum unit frame 51 and keep the unit 30 pressed downward. Therefore, it is ensured that the development roller 41 (FIG. 2) is kept pressed toward the drum 20. Since the lengthwise end portions of the development roller 41 are fitted with a pair of gap maintaining members (unshown), one for one, the development roller 41 is held with the presence of a preset amount of gap from the drum 20. That is, the gap maintaining members (unshown) maintain the preset amount of gap (roughly 300μ) between the development roller 41 and drum 20 by remaining in contact with the drum 20.

Further, one of the lengthwise ends of the unit 50 is provided with a coupling member 150 for rotating the drum 20 by receiving driving force from the apparatus main assembly 1. Referring to FIG. 4, the side cover 62 holds the electrical contact 64 of the toner remainder amount detecting member, and the electrical contact 65 for applying voltage to the development roller 41. Further, the side cover 62 has a slit 62*c*, through which the toner seal 47 is pulled out by a user.

Prior to the first time usage of the cartridge, one of the lengthwise end portions of the toner seal 47 remains exposed from the cartridge 2 through the slit 62*c* so that when a brand-new cartridge 2 is used for the first time, the toner seal 47 can be pulled out by a user.

With the provision of the above described structural features, it is possible to obtain the process cartridge 2 whose units 50 and 30 are integrally connected to each other in such a manner that the two units 50 and 30 are allowed to rotationally move relative to each other.

Next, the apparatus main assembly 1 will be described.

Figure 5:
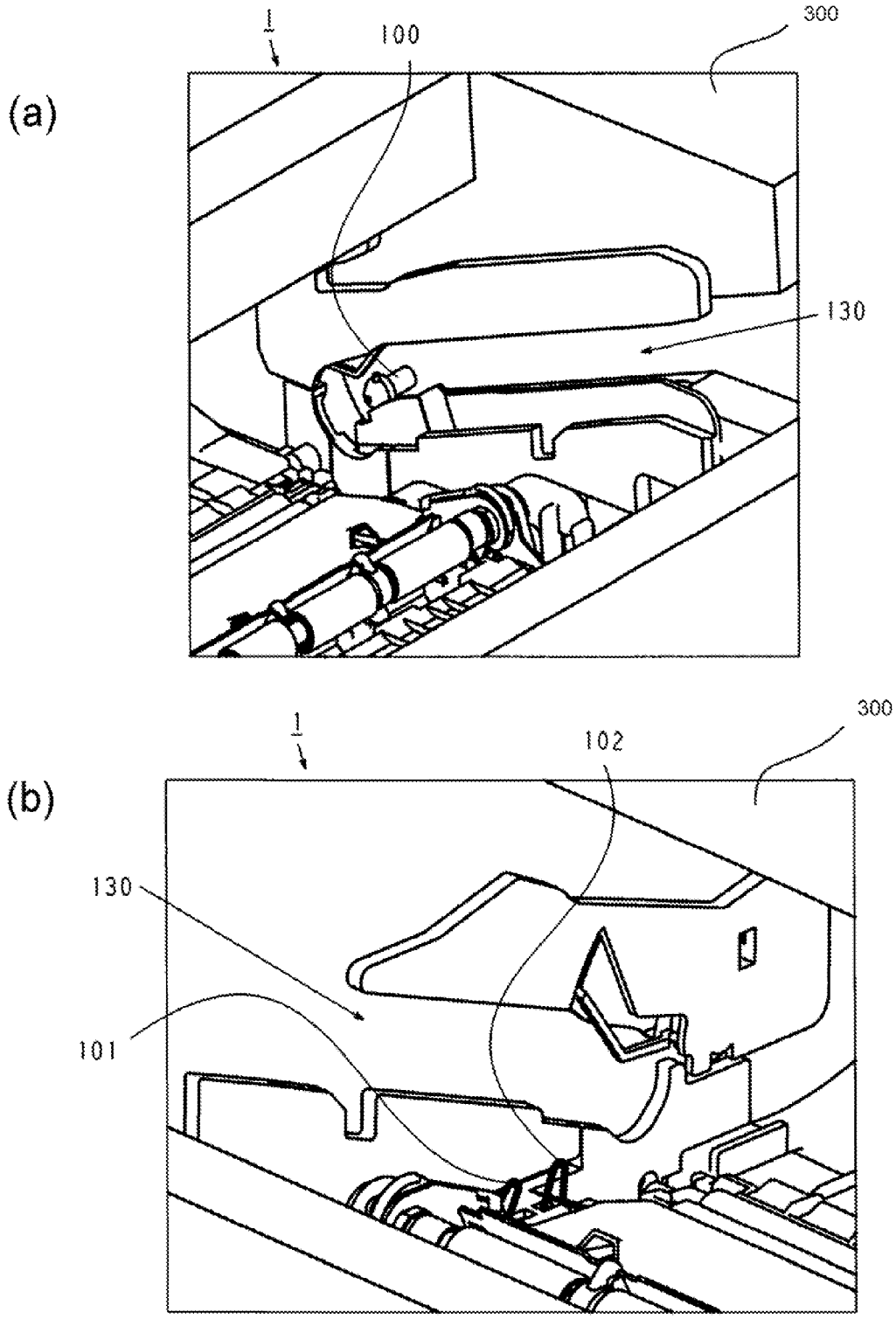
FIGS. 5(*a*) and 5(*b*) are perspective views of the cartridge compartment of the image forming apparatus in the preferred embodiment, as seen from the side from which the cartridge is driven, and the side from which the cartridge is not driven, respectively.

Referring to FIGS. 5(*a*) and 5(*b*), the apparatus main assembly 1 is provided with a cartridge mounting means 130, which is made up of a pair guiding rails for guiding the cartridge 2 when the cartridge 2 is mounted into the apparatus main assembly 1 or removed from the apparatus main assembly 1. The cartridge 2 is to be mounted into the apparatus main assembly 1 by a user along the cartridge mounting means 130 while remaining held by the user. As the cartridge 2 is mounted into the apparatus main assembly 1, the coupling member 150, which is the rotational force transmitting component of the cartridge 2, couples with a drive shaft 100 with which the apparatus main assembly 1 is provided, making it possible for the drum 20 to be rotated by the driving force from the apparatus main assembly 1. The drive shaft 100 and coupling member 150 are structured so that the coupling member 150 can couple with the drive shaft 100 from the direction which is virtually perpendicular to the axial line of the drive shaft 100, and also, so that when removing the cartridge 2 from the apparatus main assembly 1, the coupling member 150 can be uncoupled from the drive shaft 100 in the abovementioned direction. The drum 20 and development roller 41 are rotated by the rotational force received by the coupling member 150 from the drive shaft 100.

While the cartridge 2 is in its image forming position in the apparatus main assembly 1, the electrical contact 64 of the cartridge 2 remains in contact with the electrical contact 101 of the apparatus main assembly 1, and the development contact 65 of the cartridge 2 remains in contact with the development contact 102 of the apparatus main assembly 1. Therefore, voltage can be applied to the cartridge 2 from the apparatus main assembly 1.

(Structure of Toner Remainder Amount Detecting Member and its Adjacencies)

Figure 6:
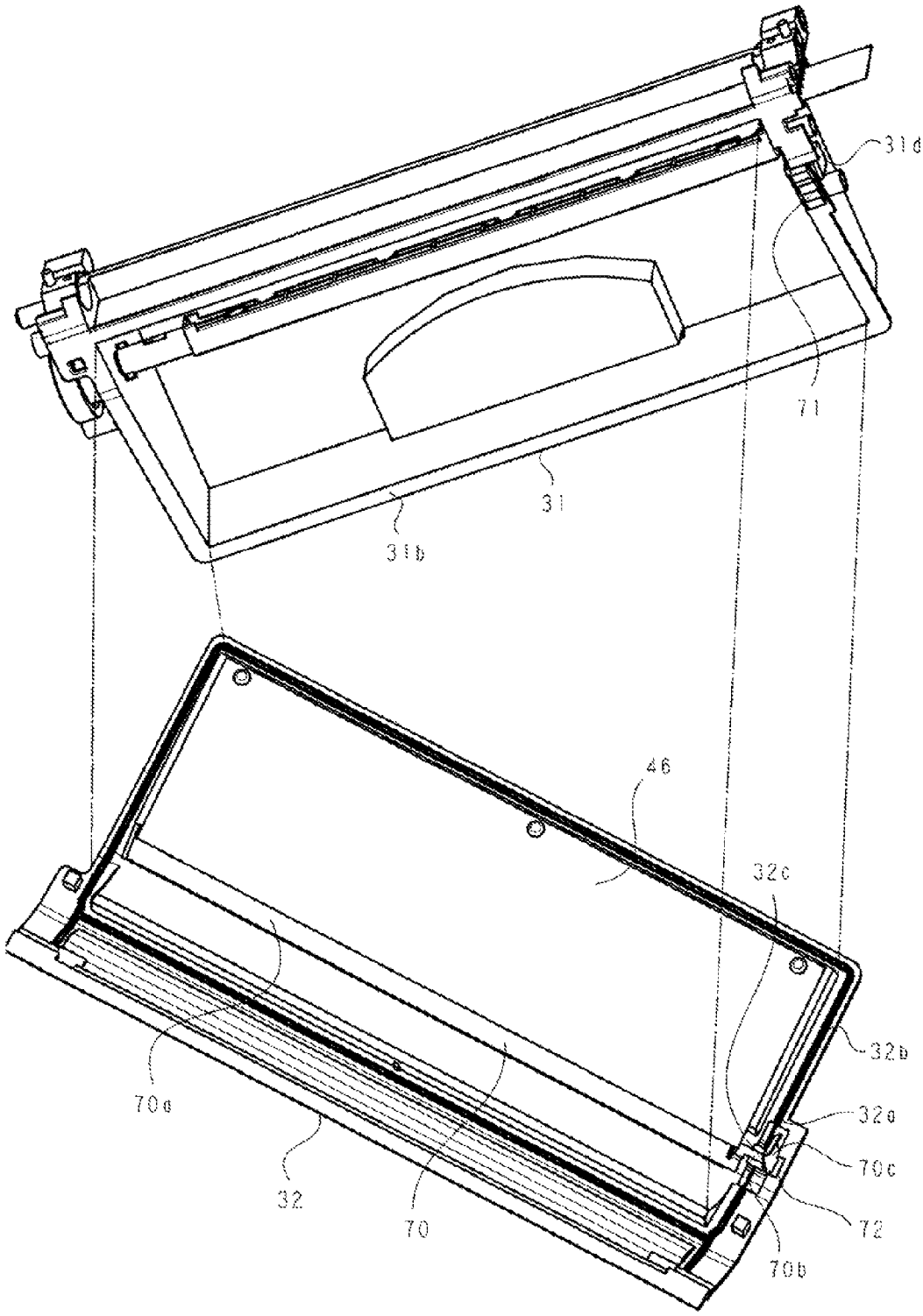
FIG. 6 is a perspective view of the developer storage container and its lid of the process cartridge, which is for showing the structure of the toner remainder amount detecting member.

Referring to FIG. 6, the surface 32*a* of the lid 32 is the surface which comes into contact with the toner storage container 31 as the lid 32 is attached to the toner storage container 31. It is provided with a welding rib 32*b* for welding the lid 32 to the container 31. The welding rib 32*b* is almost as long as the contacting surface 32*a*; the welding rib 32*b* has a gap 32*c*. The toner storage container 31 is provided with a lid contacting surface 31*b*, which comes into contact with the welding rib 32*b* as the lid 32 is attached to the container 31.

In this embodiment, the toner storage container 31 and lid 32 are joined by welding. However, the two may be joined with an adhesive, as described before.

The cartridge 2 in this embodiment has the toner remainder amount detecting means for detecting the amount of the toner T remaining in the toner storage container 31. The amount of the toner T remaining in the toner storage container 31 is detected by the detecting means 80 with which the apparatus main assembly 1 is provided.

Referring to FIG. 6, the toner remainder amount detecting member 70 is made up of a piece of metallic plate. More concretely, the detecting means 70 has a detecting portion 70*a*, an intermediary portion 70*b*, and a contact portion 70*c*. The detecting portion 70*a* is the portion within the toner chamber 45, and the intermediary portion 70*b* is the portion between the detecting portion 70*a* and contact portion 70*c*. The contact portion 70*c* is the portion that extends outward from the intermediary portion 70*b*. It is slightly bend. The toner remainder amount detecting portion 70*a* is firmly attached to the lid 32 with a piece of two-sided adhesive tape (unshown).

The detecting member 70 is attached to the lid 32 in such a manner that its lengthwise direction is parallel to the lengthwise direction of the development roller 41, and also, that its intermediary portion 70*b* coincides in position to the gap 32*c*. The intermediary portion 70*b* is held to the portion of the lid 32, which corresponds in position to the gap 32*c* of the welding rib 32*b*, with a bonding means 72 such as a piece of two-sided adhesive tape. Further, the toner remainder amount detecting member 70 is bent toward the toner storage container 31, at the border between the detecting portion 70*a* and intermediary portion 70*c*, in such a manner that after the welding of the lid 32 to the container 31, the contact portion 70*c* faces a trapezoidal protrusion 31*d*, which is on the outward side of the lengthwise end of the container 31.

The container 31 is provided with a toner sealing member 71, which is an elastic sealing member formed of foamable substance. The toner sealing member 71 is attached to the container 31 with the use of a piece of two-side adhesive tape or the like, in such a manner than its overlaps with the intermediary portion 70*b* of the toner remainder amount detecting member 70.

The lid 32 is provided with a sheet as the toner conveying member 46. This sheet 46 is fixed to the lid 32, by its edge which corresponds in position to the top edge of the slanted surface of the lid 32, by thermal crimping, or with the use of a piece of two-side adhesive tape or the like.

Incidentally, in this embodiment, two-sided adhesive tape is used as the bonding means. However, as long as the above described members, portions, etc., can be satisfactorily bonded, the bonding means does not need to be two-sided adhesive tape.

The container 31 and lid 32 are welded to each other using the following method. First, the components which are to be placed in the toner chamber 45 are attached to the inward side of the toner chamber 45. Then, the container 31 is fitted with the lid 32 so that the flange portion 31*c* of the container 31 catches the flange portion 32*f* (FIG. 30) of the lid 32. Then, ultrasonic vibrations are transmitted to the rib 32*b* of the lid 32 while keeping the flange portions 31*c* and 32*f* cramped together so that the rib 32*b* is melted by the frictional heat, and welds itself to the bonding surface 31*b* of the container 31, except for the gap portion 32*c*. That is, the container 31 and lid 32 are integrated by the bonding. Because the lid 32 is welded to the container 31 while the flange portion 31*c* of the container 31 and the flange portion 32*f* of the lid remaining cramped together, the toner sealing member 71 remains compressed in a manner to conform in shape to the gap formed by the container 31 and lid 32.

The toner chamber 45 (developer storage portion) stores the developer T, which is used for developing the above described electrostatic latent image, by the development roller 41. Further, the toner chamber 45 has the toner storage container 31 (first sub-frame portion) and the lid 32 (second sub-frame portion). It also has a hole 31*a* through which the developer T in the container 31 is supplied to the development roller 41. The hole 31*a* extends in the direction parallel to the lengthwise direction of the development roller 41, from one end of the container 31 to the other. Further, the lid 32 remains attached to the container 31 by being bonded to the container 31 by its flange portion which surrounds the lid 31, except for the gap portion 32*c* provided at one of the lengthwise end of the lid 31. Incidentally, the gap 32*c* is provided by the lid 32.

Figure 7:
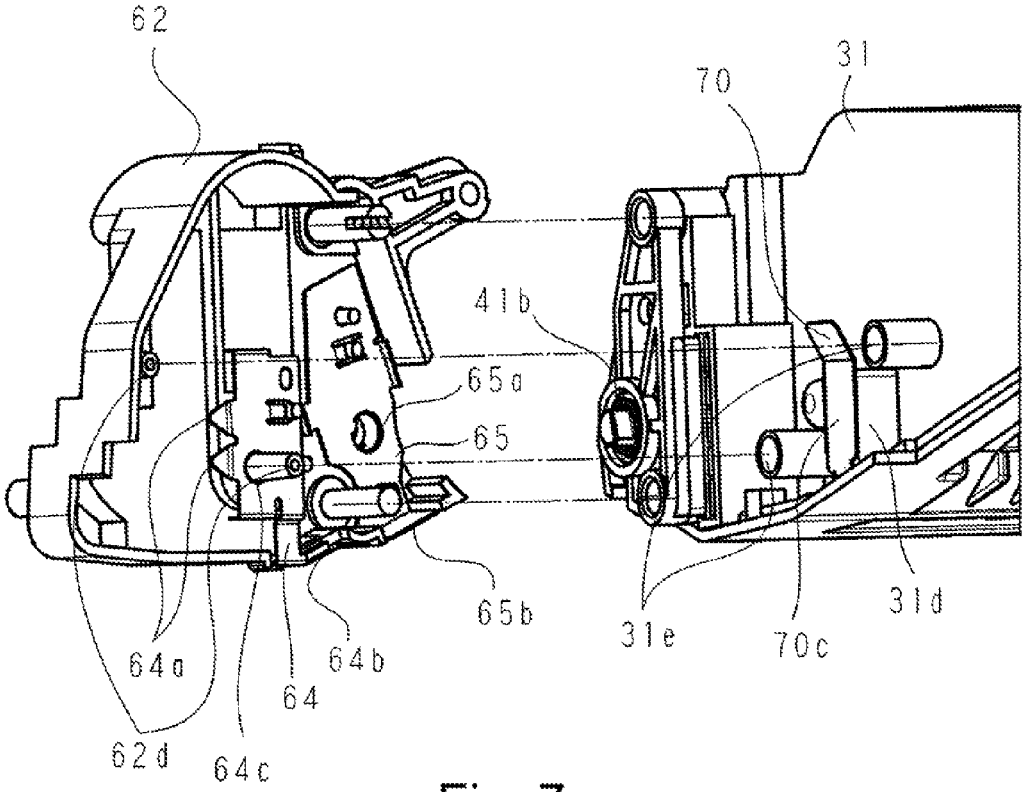
FIG. 7 is a perspective view of one of the side covers of the toner storage container, and the corresponding lengthwise end portion of the storage container, of the process cartridge, which is for showing the structure of the contact portion of the toner remainder amount detecting member.

Next, referring to FIG. 7, the side cover 62 holds the toner remainder amount detection electrical contact 64 and a development electrical contact 65. The detection contact 64 is the electrically conductive second member of the cartridge, and the development contact 65 is the electrically conductive third member of the cartridge 2. The contact 64 has a portion 64*a* and a portion 64*b*. The portion 64*a* contacts the contact portion 70*c* (bend portion) of the detecting member 70. The portion 64*b*, which is the first electrical contact of the cartridge 2, contacts the electrical point 101 (FIG. 5) of the main assembly 1. The detection contact 64 is attached to the side cover 62 in such a manner that the contact portions 64*a* and 64*b* are on the inward and outward sides, respectively, of the side cover 62.

Further, the contact 65 has a contact point 65*a* and a second electrical contact 65*b*. The contact point 65*a* contacts a development roller electrode 41*b*, which is electrically in contact with the development roller 41. The second electrical contact point 65*b* receives development bias by contacting the development contact 102 (FIG. 5) of the apparatus main assembly 1.

The toner storage container 31 is provided with a pair of side cover anchoring receptacles 31*e*, whereas the side cover 62 is provided with a pair of side cover anchoring projections 62*d*. Thus, the side cover 62 is solidly attached to the toner storage container 31 with the use of resin, smaller screws, or the like means, with the side cover anchoring projections 62*d* of the side cover 62 fitted in the side cover anchoring receptacles 31*e* of the toner storage container 31, one for one.

Figure 11:
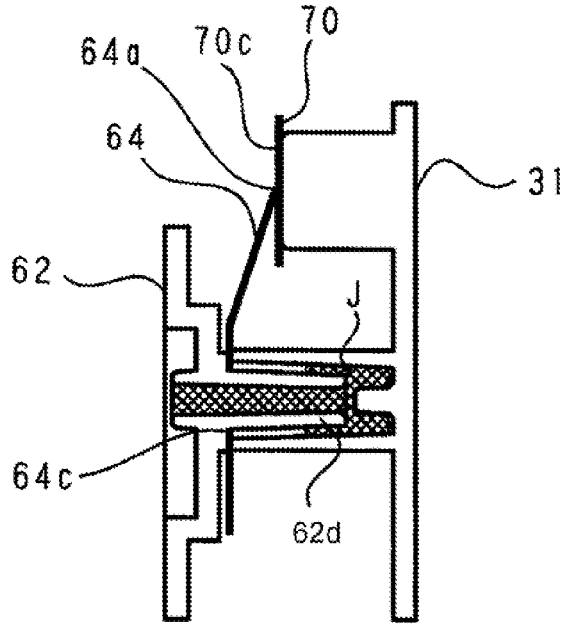
FIGS. 11(*a*) and 11(*b*) are sectional views of the electrical contact of the toner remainder amount detecting member of the cartridge, and the portion of the toner storage container, after the attachment of the electrical contact to the toner storage container.
Figure 11:
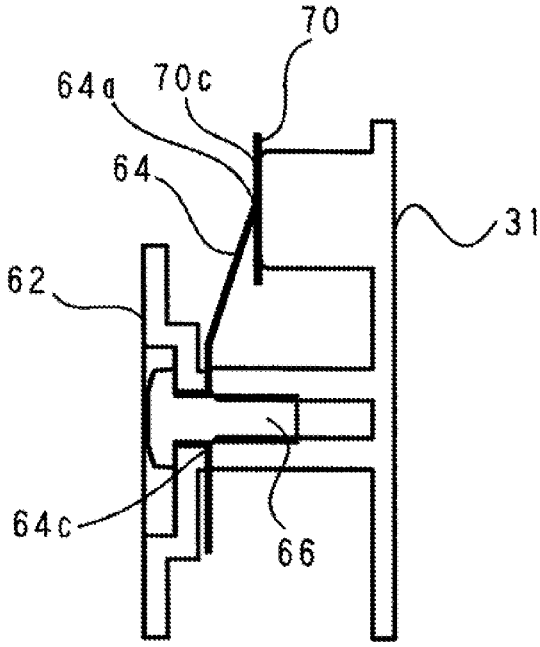

FIG. 11 is a sectional view of the contact (64) anchoring portion 62*c* of the toner storage container 31.

Referring to FIG. 11(*a*), in a case where the side cover 62 is solidly attached to the container 31 by bonding, first, the contact 64 is placed on the side cover 62 in such a manner that the anchoring projections 62*d* of the side cover 62 fit into the through holes 64*c* with which the contact 6 is provided. Then, the side cover 62 is fixed to the container 31 by injecting resin J (hatched area in FIG. 11(*a*)) between the anchoring projection 62*d* and container 31, so that the contact 64 becomes solidly attached to the container 31 by being sandwiched between the side cover 62 and container 31. The contact 64 is shaped like a leaf spring whose free end constitutes the contact point 64*a*. Thus, the contact point 64*a* is kept in contact with the contact point 70*c* of the detecting member 70 by the elasticity of the contact 64 (leaf spring).

The above described structural arrangement ensures that the contact point 64*a* of the contact 64 remains in contact with the contact point 70*c* of the detecting member 70.

On the other hand, referring to FIG. 11(*b*), in a case where the side cover 62 is solidly attached to the container 31 with the use of small screws, a small screw 66 is put through the through hole 64*c* of the contact 64. Also in this case, the contact 64 is solidly attached to the container 31 by being sandwiched between the side cover 62 and container 31 as it is in the case where resin is used as the means for securely holding the contact 64.

The side cover 62 and container 31 are structured so that whether the side cover 62 is attached to the container 31 with the use of resin or small screws, the anchoring portion 62*d* presses the adjacencies of the base portion of the contact 64 (leaf spring) whose tip portion is the contact point 64*a*. Thus, this structural arrangement makes it possible to prevent the problem that the contact 64 is dislodged by the pressure which the contact 64 receives. That is, it ensures that the contact pressure remains stable.

Next, referring to FIGS. 8 and 9, the toner sealing portion will be described.

Figure 8:
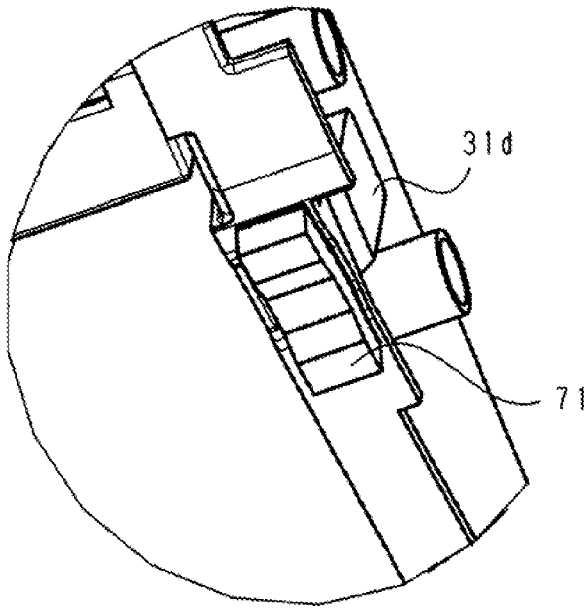
FIG. 8 is a perspective view of the portions of the cartridge having the electrically conductive first member and toner sealing member, which is for showing the structure of the toner sealing member.
Figure 8:
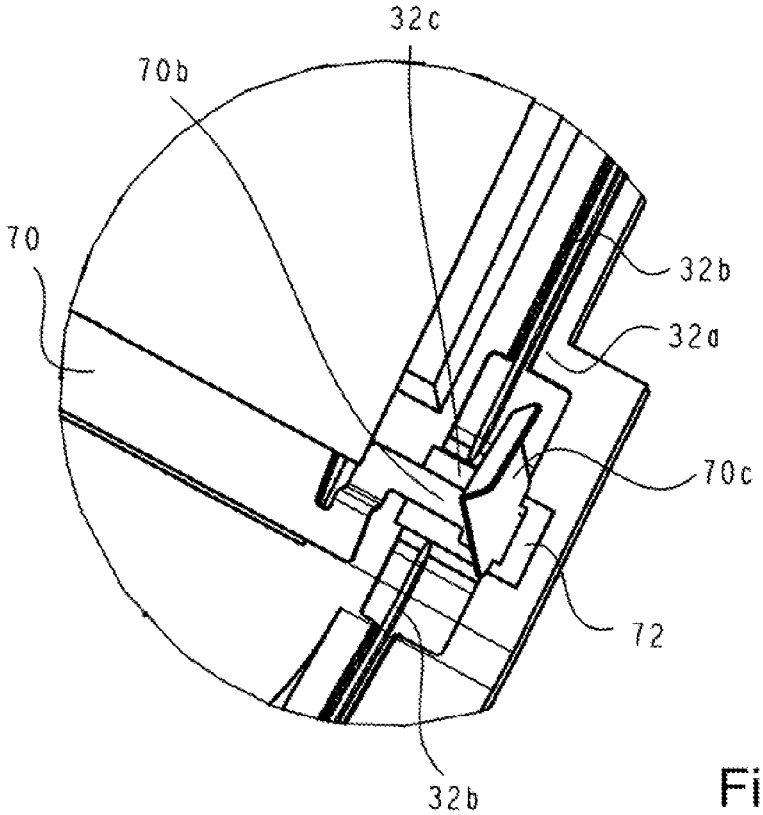
Figure 9:
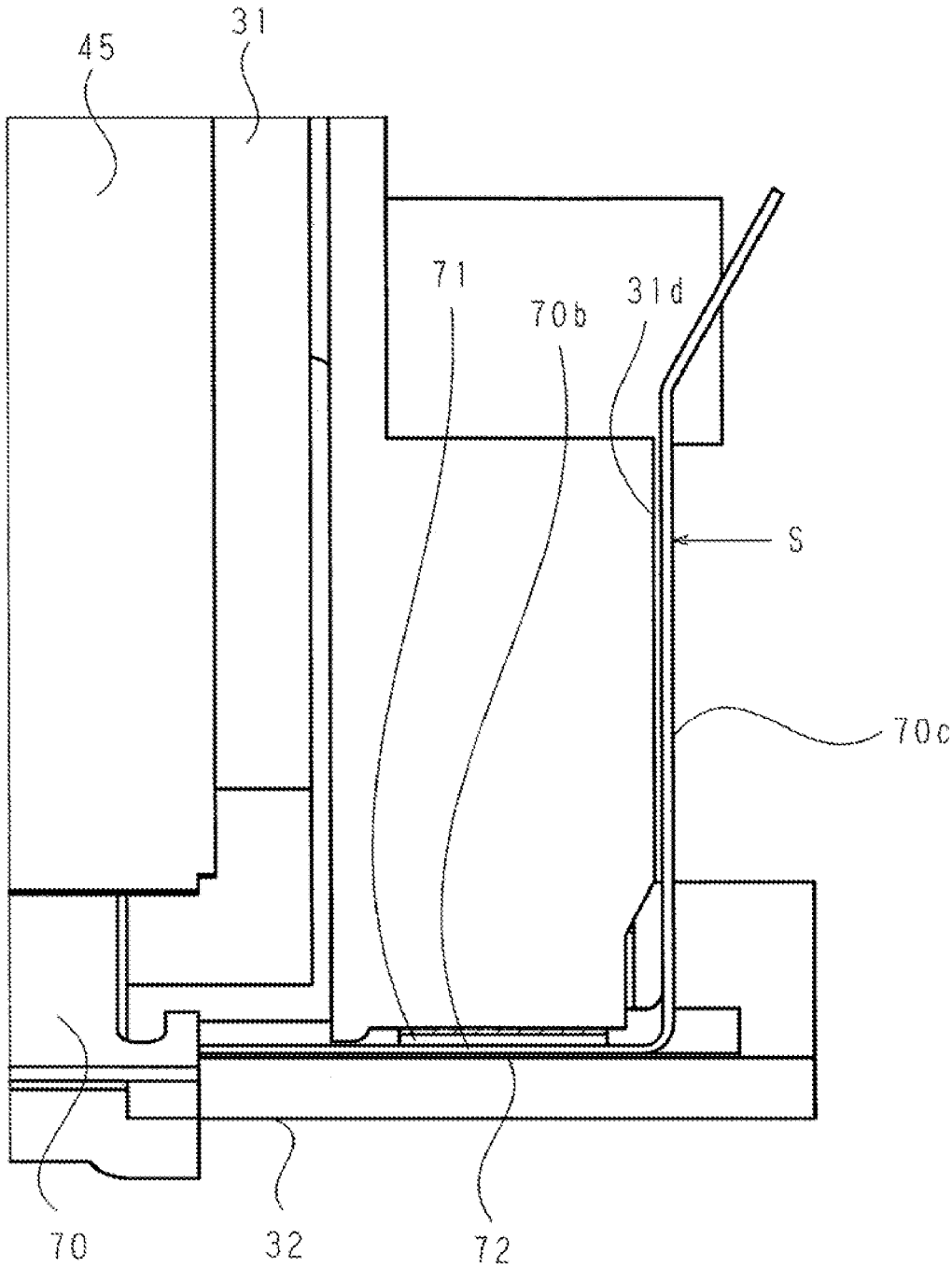
FIG. 9 is a sectional view of the end portion of the toner storage container having the electrically conductive first member, after the welding of the toner storage container lid to the container.

FIG. 8 is a perspective view of the toner remainder amount detecting member 70 and toner sealing member 71 before the welding of the lid 32 to the container 31. FIG. 9 is a sectional view of the toner remainder amount detecting member 70 and toner sealing member 71 after the welding of the lid 32 to the container 31. The intermediary portion 70*b* of the detecting member 70 is fixed to the lid 32 with the use of a piece of two-sided adhesive tape. The sealing member 71 is bonded to the container 31. Further, after the welding of the lid 32 to the container 31, the sealing member 71 remains compressed in its thickness direction, and therefore, the detecting member 70 remains sandwiched between the two-sided adhesive tape and sealing member 71. That is, the sealing member 7 keeps sealed the outward toner passage from the toner chamber 45. That is, the presence of the sealing member 71 prevents the toner in the toner chamber 45 from leaking outward. The contact point 70*c* of the detecting member 70 remains pressed by the contact 64 of the side cover 62, in the direction indicated by an arrow mark S. The container 31 is provided with the trapezoidal protrusion 31*d*, which is positioned so that it can back up the detecting member 70 against the contact pressure. That is, the protrusion 31*d* prevents the contact point 70*c* from being excessively flexed by the contact pressure. In other words, the trapezoidal protrusion 31*d* prevents the contact point 70*c* from collapsing.

Not only can the above described structure arrangement make it possible to better seal the toner storage container 31, but also, to stabilize the contact pressure between the toner remainder amount detecting member 70 and contact 64.

(Description of Structure of Stirring means)

Figure 10:
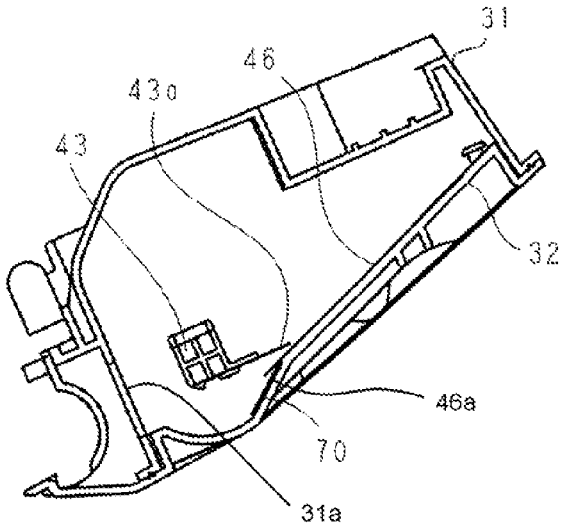
FIGS. 10(*a*)-10(*c*) are sectional views of the first portion of the process cartridge, which shows the relationship among the stirring member, toner conveying member, and toner remainder amount detecting member.
Figure 10:
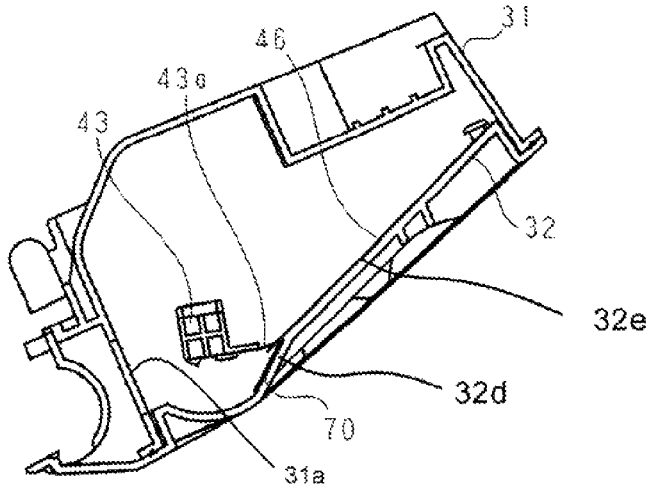
Figure 10:
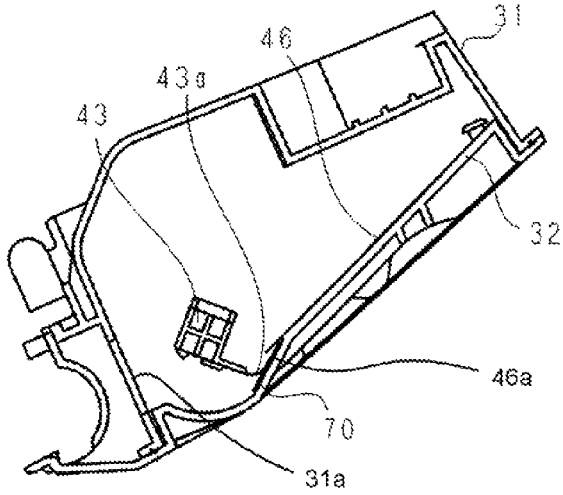

FIG. 10 is a sectional view of the development unit 30.

As described above, the flexible sheet 46, which is a member for conveying toner, is on the bottom surface of the toner chamber 45, that is, the inward surface of the lid 32. It is positioned so that the edge portion of the sheet 46, which is on the toner outlet side, overlaps with the top edge portion of the detecting member 70, in terms of the vertical direction.

When the cartridge 2 is in its image forming position in the apparatus main assembly 1, the first surface 32*d* of the toner chamber 45, which is holding the detecting member 70, inclines downward from the second surface 32*e*, by which the sheet 46 is held. Further, the edge portion 46*a* (FIG. 10) of the sheet 46, which is on the toner outlet side, projects beyond the second surface 32*e*.

FIG. 10(*a*) shows, in cross section, the development unit 30 immediately before the sweeping edge portion 42*a* of the stirring member 43 comes into contact with the sheet 46. Next, referring to FIG. 10(*b*), as the stirring member 43 rotates, it causes the sweeping edge portion 42*a* of the stirring member to flex. Thus, as the stirring member 43 rotates further, the edge portion 46*a* of the sheet 46 snaps back. As a result, the edge portion 46*a* of the sheet 46 (toner conveying member) vibrates, making it easier for the toner on the sheet 46 to slide downward on the sheet 46. Next, referring to FIG. 10(*c*), as the stirring member 43 rotates further after it allowed the edge portion 46*a* of the sheet 46 to snap back, the edge portion 46*a* of the sheet 46 sweeps (rubs) the inward surface of the detecting member 70.

The above described structural arrangement for the cartridge 2 makes it possible to provide a process cartridge 2, which is significantly smaller in the angle of the lid 32 relative to the horizontal direction when the cartridge 2 is in the image forming position in the apparatus main assembly 1, than a cartridge in accordance with the prior art, that is, a cartridge 2 in which the sheet 46 is not present. In other words, the above described structural arrangement for the cartridge 2 makes it possible to more efficiently use the internal space of the toner chamber 45. Further, it makes the edge portion 46*a* of the sheet 46 overlap with the top edge portion of the detecting member 70. Therefore, it makes it possible to provide a process cartridge which is smaller in the area in which the edge portion of the detecting member 70 rubs against toner, being therefore smaller in the amount of toner deterioration than a cartridge in accordance with the prior art.

The above described structural arrangement for the cartridge 2 in this embodiment can be summarized as follows:

(1) The cartridge 2 is removably mountable in the main assembly 1 of an image forming apparatus 300. The cartridge 2 has: the drum 20; development roller 41 for developing an electrostatic latent image formed on the drum; and toner chamber 45 (developer storage) in which the developer T to be used for the development of the electrostatic latent image is stored. The toner chamber 45 has the toner storage container 31 (first sub-frame portion), which has the long and narrow hole 31*a*, which is provided for supplying the development roller 41 with the developer T stored in the toner chamber 45, and which extends in parallel to the development roller 41, virtually from one end of the toner chamber 45 to the other. Further, the toner chamber 45 has the lid 32 (second frame portion), which is bonded to the container 31 by its peripheral portion (flange-like portion), except for the gap 32*c* of the welding rib 32*b*, which is at one of the lengthwise ends of the lid 32.

Further, the cartridge 2 has: the side cover 62, which is attached to one of the lengthwise ends of the toner chamber 45 to support one end of the development roller 41; and the side cover 61 attached to the other lengthwise end of the toner chamber 45 to support the other end of the development roller 41. Further, the cartridge 2 has the electrically conductive first member 70, which is for generating static electricity between itself and development roller 41 as development bias is applied to the development roller 41.

The electrically conductive member 70 is attached to the lid 32 (second sub-frame portion) in such a manner that its lengthwise direction becomes parallel to the abovementioned lengthwise direction. The electrically conductive member 70 has: the inward portion 70*a*, which is inside the toner chamber 45; intermediary portion 70*b*, which extends from the inward portion 70*a* to the outward surface of the toner chamber 45 through the gap 32*c*; and outward portion 70*c*, which is slightly bent portion and extends roughly perpendicularly from the outward end of the intermediary portion 70*c*.

Further, the cartridge 2 has the electrically conductive second member 64 (second contact). The electrically conductive second member 64 has: the contact point 64*a*, which is kept in contact with the outward portion 70*c* of the electrically conductive member 70 by the elasticity of the conductive member 70; and electrically conductive first contact point 64*b*, which is in electrical connection to the contact point 64*a*. The contact point 64*b* is for transmitting to the apparatus main assembly 1, electrical signals which reflect the amount of static electricity generated between the development roller 41 and electrically conductive member 70. Further, the contact 64 is attached to the side cover 62 in such a manner that the contact points 64*a* and 64*b* are positioned on the inward and outward sides, respectively, of the side cover 62.

The above described structural arrangement makes it possible to simplify in structure the contacts, which extend from the inward side of the toner chamber 45 to the outward side. Therefore, it can reduce the cartridge 2 in cost.

(2) The portion of the electrically conductive member 70, which corresponds in position to the gap 32*c*, is pasted to the lid 32, with the use of a piece of two-sided adhesive tape 72 (bonding member). Further, this portion of the electrically conductive member 70 is held to the toner chamber 45 by being sandwiched between the piece of two-sided adhesive tape 72, and the elastic sealing member 71 attached to the container 31.

Thus, not only did the usage of the above described structural arrangement make it possible to simplify the electrical contacts in structure, but also, to better seal the cartridge 2 in terms of toner leakage.

(3) The bent portion 70*c* of the electrically conductive member 70 faces the trapezoidal protrusion 31*d*, which is on one of the lengthwise outward end surfaces of the toner chamber 45. Thus, as the contact point 64*a* is pressed upon the bent portion 70*c*, the bent portion 70*c* comes into contact with the protrusion 31*d*. That is, the protrusion 31*d* prevents the bent portion 70*c* from being flexing beyond where the protrusion 31*d* is.

The usage of this structural arrangement made it possible to minimize the fluctuation of the contact pressure between the electrically conductive member 70 and contact 64. Thus, it made it possible to provide a process cartridge which is reliable in terms of the electrical connection between its electrically conductive member 70 and contact 64.

(4) The side cover 62 holds the electrically conductive third member 65, which has the second electrical contact point 65*a* for receiving the development bias to be applied to the development roller 41 from the apparatus main assembly 1 when the cartridge 2 is in the image forming position in the apparatus main assembly 1.

This structural arrangement uses only the side cover 62 to precisely position the electrically conductive members 64 and 65. Therefore, it can minimize the fluctuation of the electrostatic capacity between the electrically conductive members 64 and 65, and therefore, can provide a process cartridge 2 capable of detecting the amount of the toner remainder therein at a significantly higher level of accuracy than a process cartridge in accordance with the prior art.

(5) The cartridge 2 is provided with the removable toner seal 47 (developer seal) for sealing the hole 31*a*. Further, the side cover 62 is provided with the hole 62*c*, through which one of the lengthwise ends of the toner seal 47 is extended outward from the cartridge 2 to allow a user to pull the toner seal 47 out of the cartridge 2 before the cartridge 2 is used for the first time.

Providing the cartridge 2 with the removable toner seal 47 made it possible to keep the cartridge 2 better sealed before the cartridge 2 is used for the first time.

(6) The cartridge 2 is provided with the stirring member 43 which is rotated for stirring the developer T in the toner chamber 45. The stirring member 43 rubs the inwardly facing surface 70*a* of the electrically conductive member 70.

This structural arrangement made it possible to reduce the amount by which the toner remains on the detecting member 70, and therefore, made it possible to provide a process cartridge capable of detecting the amount of the toner remainder therein at a significantly higher level of accuracy than a process cartridge in accordance with the prior art.

(7) The cartridge 2 and apparatus main assembly 1 are structured so that when the cartridge 2 is in its image forming position in the apparatus main assembly 1, the lid 32 faces downward. Further, the cartridge 2 is provided with the flexible sheet 46, which partially overlaps with a part 70*a* of the electrically conductive member 70, in terms of the vertical direction, when the cartridge 2 is in its image forming position in the apparatus main assembly 1.

This structural arrangement can prevent the stirring member 43 from directly rubbing the part 70*a* of the electrically conductive member 70, and therefore, can reduce the amount by which the toner is deteriorated.

(8) The cartridge 2 and apparatus main assembly 1 are structured so that when the cartridge 2 is in its image forming position in the apparatus main assembly 1, the first surface 32*d*, which holds the electrically conductive member 70, extends diagonally downward from the second surface 32*e*, which holds the flexible sheet 46. Further, the bottom edge portion 46*a* of the sheet 46 extends beyond the second surface 32*e*. Thus, when the stirring member 43 rotates, the sweeping edge portion 42*a* of the stirring member 43 causes the sheet 46 to vibrate, by coming into contact with the bottom edge portion 46*a* of the sheet 46. Further, the sweeping edge portion 42*a* of the stirring member 43 rubs the surface of the inward portion 70*a* of the electrically conductive member 70.

This structural arrangement makes it possible for the toner to be conveyed even if the angle of the second surface 32*e* is significantly smaller than the angle of the counterpart in a cartridge in accordance with the prior art. That is, it makes it possible to more efficiently use the internal space of a cartridge. Therefore, this structural arrangement makes it possible to provide an electrophotographic image forming apparatus 300 which is significantly smaller than an electrophotographic image forming apparatus 300 in accordance with the prior art.

(9) The main assembly 1 of the electrophotographic image forming apparatus 300 has the detecting means 80 (FIG. 10) for detecting the amount of the developer in the cartridge 2, based on the electrical signals received from the first portion 64*b* of the electrical contact 64. Therefore, the amount of the developer in the cartridge 2 can be detected by the apparatus main assembly 1, based on the electrical signals sent from the cartridge 2.

According to the preferred embodiment described above, the electrically conductive first member of a process cartridge, which is to extend from the inward side of the development unit of the process cartridge to the outward side of the development unit, can be more efficiently attached to the development unit, in terms of spatial efficiency, compared to the counterpart of a process cartridge in accordance with the prior art.

Further, according to the preferred embodiment, it is possible to ensure that the electrically conductive first and second members make contact, and remain in contact, with each other.

Also according to the preferred embodiment described above, it is possible to ensure that the contact points in a process cartridge make contact, and remain contact, with the counterparts.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 198424/2008 filed Jul. 31, 2008 which is hereby incorporated by reference.

What is claimed is:

1. A process cartridge detachably mountable to a main assembly of an electrophotographic image forming apparatus, said process cartridge comprising:

an electrophotographic photosensitive drum;

a developing roller for developing an electrostatic latent image formed on said electrophotographic photosensitive drum;

a developer accommodating portion for accommodating the developer to be used for development of the electrostatic latent image by said developing roller, said developer accommodating portion including a first frame having an opening extended in a longitudinal direction of said developing roller for supplying accommodated developer to said developing roller, and a second frame mounted to said first frame by being bonded at a periphery thereof except for a non-bonding portion provided in a direction substantially perpendicular to the longitudinal direction at one longitudinal end portion;

one end portion member, mounted to said one longitudinal end portion, for supporting one end of said developing roller;

an another end portion member, mounted to the other longitudinal end portion of said developer accommodating portion, for supporting the other end of said developing roller;

a first electroconductive member for providing an electrostatic capacity between itself and said developing roller when a developing bias voltage is applied to said developing roller, said first electroconductive member including an inner side portion provided on said second frame along the longitudinal direction and placed in said developer accommodating portion, and an outer side portion extending from the inner side portion through the non-bonded portion to an outside of said developer accommodating portion where said outer side portion is bent to provide a bent portion; and a second electroconductive member including a contact portion elastically contacting to said bent portion, and a first electrical contact portion, electrically connected to said contact portion, for transmitting, to the main assembly, an electric signal corresponding to a value of the electrostatic capacity provided between said developing roller and said first electroconductive member, wherein said second electroconductive member is mounted to said one end portion member such that contact portion is inside said one end portion member and that first electrical contact portion is outside said one end portion member.

2. A process cartridge according to claim 1, wherein said first electroconductive member is pasted to said second frame by bonding means at the non-bonded portion, and said first electroconductive member is mounted to said developer accommodating portion in the state in which it is sandwiched by said bonding means and an elastic sealing member mounted to said first frame.

3. A process cartridge according to claim 1 or 2, wherein said bent portion is opposed to a projection provided on an outside of said developer accommodating portion at one longitudinal end portion, and wherein when said contact portion is elastically contacted to said bent portion, said bent portion contacts to said projection by which said bent portion is prevented from bending further.

4. A process cartridge according to claim 3, wherein said one end portion member is provided with a third electroconductive member having a second electrical contact portion for receiving a developing bias voltage to be applied to said developing roller from the main assembly in the state in which said process cartridge is mounted to the main assembly.

5. A process cartridge according to claim 1 or 2, further comprising a developer seal member for unsealably sealing said opening, wherein said one end portion member is provided with a through opening for permitting one end of said developer seal member to be out of said process cartridge to facilitate user pulling of the developer seal member off said process cartridge upon start of use of said process cartridge.

6. A process cartridge according to claim 1 or 2, further comprising a stirring member for stirring the developer in said developer accommodating portion by rotation thereof, wherein said stirring member rubs a surface of the inner side portion of said first electroconductive member when said stirring member rotates.

7. A process cartridge according to claim 1 or 2, wherein said second frame provides a bottom surface of said developer accommodating portion in the state in which process cartridge is mounted to the main assembly, said second frame is provided with a flexible sheet which partly overlaps with a part of said first electroconductive member with respect to a perpendicular direction.

8. A process cartridge according to claim 7, wherein in the state in which said process cartridge is mounted to the main assembly, a first plane in which said first electroconductive member is provided is lower than a second plane in which said flexible sheet is provided, and an end of said flexible sheet projects beyond the second plane, wherein when said stirring member is rotated, an end of said stirring member contacts the end of said flexible sheet to impart vibration to said flexible sheet and rubs the surface of said inner side portion of said first electroconductive member.

9. An electrophotographic image forming apparatus, including a main assembly, to which a process cartridge is detachably mounting, said apparatus comprising:

a process cartridge including, an electrophotographic photosensitive drum, a developing roller for developing an electrostatic latent image formed on said electrophotographic photosensitive drum, a developer accommodating portion for accommodating the developer to be used for development of the electrostatic latent image by said developing roller, said developer accommodating portion including a first frame having an opening extended in a longitudinal direction of said developing roller for supplying accommodated developer to said developing roller, and a second frame mounted to said first frame by being bonded at a periphery thereof except for a non-bonding portion provided in a direction substantially perpendicular to the longitudinal direction at one longitudinal end portion, one end portion member, mounted to said one longitudinal end portion, for supporting one end of said developing roller, an another end portion member, mounted to the other longitudinal end portion of said developer accommodating portion, for supporting the other end of said developing roller, a first electroconductive member for providing an electrostatic capacity between itself and said developing roller when a developing bias voltage is applied to said developing roller, said first electroconductive member including an inner side portion provided on said second frame along the longitudinal direction and placed in said developer accommodating portion, and an outer side portion extending from the inner side portion through the non-bonded portion to an outside of said developer accommodating portion where said outer side portion is bent to provide a bent portion, and a second electroconductive member including a contact portion elastically contacting to said bent portion, and a first electrical contact portion, electrically connected to said contact portion, for transmitting, to said main assembly, an electric signal corresponding to a value of the electrostatic capacity provided between said developing roller and said first electroconductive member, wherein said second electroconductive member is mounted to said one end portion member such that contact portion is inside said one end portion member and that first electrical contact portion is outside said one end portion member; and detecting means for detecting an amount of the developer of said process cartridge by an electric signal received from said first electrical contact portion.

10. An apparatus according to claim 9, wherein said first electroconductive member is pasted to said second frame by bonding means at the non-bonded portion, and said first electroconductive member is mounted to said developer accommodating portion in the state in which it is sandwiched by said bonding means and an elastic sealing member mounted to said first frame.

11. An apparatus according to claim 9 or 10, wherein said bent portion is opposed to a projection provided on an outside of said developer accommodating portion at one longitudinal end portion, and wherein when said contact portion is elastically contacted to said bent portion, said bent portion contacts to said projection by which said bent portion is prevented from bending further.

12. An apparatus according to claim 11, wherein said one end portion member is provided with a third electroconductive member having a second electrical contact portion for receiving a developing bias voltage to be applied to said developing roller from the main assembly in the state in which said process cartridge is mounted to the main assembly.

13. An apparatus according to claim 9 or 10, wherein said process cartridge further comprises a developer seal member for unsealably sealing said opening, said one end portion member is provided with a through opening for permitting one end of said developer seal member to be out of said process cartridge to facilitate user pulling of the developer seal member off said process cartridge upon start of use of said process cartridge.

14. An apparatus according to claim 9 or 10, wherein said process cartridge further comprises a stirring member for stirring the developer in said developer accommodating portion by rotation thereof, stirring member rubs a surface of the inner side portion of said first electroconductive member when said stirring member rotates.

15. An apparatus according to claim 9 or 10, wherein said second frame provides a bottom surface of said developer accommodating portion in the state in which process cartridge is mounted to the main assembly, said second frame is provided with a flexible sheet which partly overlaps with a part of said first electroconductive member with respect to a perpendicular direction.

16. An apparatus according to claim 15, wherein in the state in which said process cartridge is mounted to the main assembly, a first plane in which said first electroconductive member is provided is lower than a second plane in which said flexible sheet is provided, and an end of said flexible sheet projects beyond the second plane, wherein when said stirring member is rotated, an end of said stirring member contacts the end of said flexible sheet to impart vibration to said flexible sheet and rubs the surface of said inner side portion of said first electroconductive member.

* * * * *